US007611335B2

(12) United States Patent
Warren et al.

(10) Patent No.: US 7,611,335 B2
(45) Date of Patent: Nov. 3, 2009

(54) TWO SET-POINT PILOT PISTON CONTROL VALVE

(75) Inventors: Matthew R. Warren, Buffalo, NY (US); Joseph M. Bona, Williamsville, NY (US); Ernesto Jose Gutierrez, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 505 days.

(21) Appl. No.: 11/375,999

(22) Filed: Mar. 15, 2006

(65) Prior Publication Data

US 2007/0217923 A1 Sep. 20, 2007

(51) Int. Cl.
*F04B 1/26* (2006.01)

(52) U.S. Cl. ..... 417/222.2

(58) Field of Classification Search ..... 417/222.2, 417/222.1, 269, 213, 270; 91/12.2, 505, 91/506; 251/129.02
See application file for complete search history.

(56) References Cited

U.S. PATENT DOCUMENTS

| | | | | |
|---|---|---|---|---|
| 4,526,516 A | | 7/1985 | Swain et al. | |
| 4,606,705 A | * | 8/1986 | Parekh | 417/222.2 |
| 5,518,374 A | | 5/1996 | Ota et al. | 417/222.2 |
| 5,531,572 A | | 7/1996 | Kimura et al. | 417/222.2 |
| 5,577,897 A | | 11/1996 | Inagaki et al. | 417/310 |
| 5,620,310 A | | 4/1997 | Takenaka et al. | 417/222.2 |
| 5,702,235 A | * | 12/1997 | Hirota et al. | 417/222.2 |
| 5,865,604 A | | 2/1999 | Kawaguchi et al. | 417/222.2 |
| 5,871,337 A | | 2/1999 | Fukanuma et al. | 417/222.2 |
| 5,890,370 A | | 4/1999 | Sakakibara et al. | 62/222 |
| 5,934,094 A | | 8/1999 | Itoh et al. | 62/222 |
| 6,010,314 A | | 1/2000 | Kobayashi et al. | 417/222.2 |
| 6,045,337 A | | 4/2000 | Tokumasu | 417/213 |
| 6,126,405 A | | 10/2000 | Kawaguchi et al. | 417/222.2 |
| 6,146,106 A | | 11/2000 | Suitou et al. | 417/222.2 |
| 6,164,925 A | | 12/2000 | Yokomachi et al. | 417/222.2 |

(Continued)

FOREIGN PATENT DOCUMENTS

EP 0 945 617 9/1999

(Continued)

OTHER PUBLICATIONS

European Search Report dated Aug. 1, 2008.

*Primary Examiner*—Devon C Kramer
*Assistant Examiner*—Todd D Jacobs
(74) *Attorney, Agent, or Firm*—Patrick M. Griffin

(57) ABSTRACT

The subject invention provides a compressor assembly for an air conditioning system for a vehicle. The compressor assembly is of the variable displacement angle wobble plate type, and includes a housing that defines a suction cavity, a discharge cavity, and a crankcase. An electronic control valve controls the flow of a fluid between the discharge cavity and the crankcase for pressurizing the crankcase to de-stroke the compressor assembly. The control valve includes a pressure sensing member, which is responsive to a suction pressure to open fluid communication between the discharge cavity and the crankcase when the suction pressure is below a pre-determined set-point. The control valve also includes an actuator port in fluid communication with the discharge cavity for urging the member into the activated position to open fluid communication between the discharge cavity and the crankcase when the suction pressure is above the pre-determined set-point.

12 Claims, 4 Drawing Sheets

U.S. PATENT DOCUMENTS

| | | | | |
|---|---|---|---|---|
| 6,182,457 | B1 | 2/2001 | Enderle | 62/222 |
| 6,200,105 | B1 * | 3/2001 | Kawaguchi et al. | 417/222.2 |
| 6,213,727 | B1 | 4/2001 | Kawaguchi | 417/222.2 |
| 6,217,290 | B1 * | 4/2001 | Imai et al. | 417/222.1 |
| 6,217,292 | B1 | 4/2001 | Ota et al. | 417/222.2 |
| 6,244,159 | B1 | 6/2001 | Kimura et al. | 92/12.2 |
| 6,260,369 | B1 | 7/2001 | Yokomachi et al. | 62/228.5 |
| 6,305,179 | B1 | 10/2001 | Hirota | 62/225 |
| 6,334,759 | B1 | 1/2002 | Kaneko et al. | 417/222.2 |
| 6,358,017 | B1 | 3/2002 | Ota et al. | 417/222.2 |
| 6,364,627 | B1 | 4/2002 | Herder et al. | 417/222.2 |
| 6,382,926 | B2 | 5/2002 | Ota et al. | 417/222.2 |
| 6,385,979 | B2 | 5/2002 | Ota et al. | 62/115 |
| 6,385,982 | B1 | 5/2002 | Ota et al. | 62/209 |
| 6,386,834 | B1 | 5/2002 | Kimura et al. | 417/222.2 |
| 6,398,516 | B1 | 6/2002 | Kawaguchi et al. | 417/222.2 |
| 6,412,294 | B2 | 7/2002 | Kimura et al. | 62/228.3 |
| 6,434,956 | B1 | 8/2002 | Ota et al. | 62/133 |
| 6,447,258 | B2 | 9/2002 | Ota et al. | 417/222.2 |
| 6,453,685 | B2 | 9/2002 | Ota et al. | 62/115 |
| 6,457,319 | B1 | 10/2002 | Ota et al. | 62/228.3 |
| 6,481,227 | B1 | 11/2002 | Ota et al. | 62/209 |
| 6,481,976 | B2 | 11/2002 | Kimura et al. | 417/222.2 |
| 6,484,520 | B2 | 11/2002 | Kawaguchi et al. | 62/133 |
| 6,508,071 | B2 | 1/2003 | Ota et al. | 62/228.3 |
| 6,514,049 | B2 | 2/2003 | Mera et al. | 417/222.2 |
| 6,519,960 | B2 | 2/2003 | Suitou et al. | 62/228.3 |
| 6,540,488 | B2 | 4/2003 | Takai et al. | 417/222.2 |
| 6,572,341 | B2 | 6/2003 | Kimura et al. | 417/213 |
| 6,637,228 | B2 | 10/2003 | Umemura et al. | 62/228.3 |
| 6,662,581 | B2 | 12/2003 | Hirota et al. | 62/228.3 |
| 6,663,355 | B2 | 12/2003 | Kubo et al. | 417/222.2 |
| 6,663,358 | B2 | 12/2003 | Loprete et al. | 417/313 |
| 6,702,251 | B2 | 3/2004 | Iwata et al. | 251/129.18 |
| 6,716,007 | B2 | 4/2004 | Kim et al. | 418/23 |
| 6,733,246 | B2 | 5/2004 | Imai et al. | 417/222.2 |
| 6,746,214 | B2 | 6/2004 | Okada et al. | 417/222.2 |
| 6,799,952 | B2 | 10/2004 | Urbank et al. | 417/222.2 |
| 2002/0144512 | A1 * | 10/2002 | Fukanuma et al. | 62/228.3 |
| 2005/0287014 | A1 * | 12/2005 | Umemura et al. | 417/222.1 |

FOREIGN PATENT DOCUMENTS

| | | | |
|---|---|---|---|
| EP | 1155888 | A2 | 11/2001 |
| EP | 1375918 | A1 | 1/2004 |

* cited by examiner

TWO SET-POINT PILOT PISTON CONTROL VALVE

BACKGROUND OF THE INVENTION

1. Field of the Invention

The subject invention relates to a compressor assembly for a climate control system of a vehicle, and more specifically to a variable displacement compressor assembly.

2. Description of the Prior Art

U.S. Pat. No. 4,606,705, issued to Parekh, discloses a variable angle wobble plate compressor assembly used in vehicle air conditioning systems. The compressor assembly of the '705 patent includes a compressor housing defining a suction cavity for receiving a fluid (refrigerant) at a suction pressure, a discharge cavity for receiving the fluid from the suction cavity at a discharge pressure higher than the suction pressure, and a crankcase in fluid communication with the discharge cavity. The crankcase encloses a variable angle wobble plate and at least one compressor piston having a variable piston stroke therein. A control valve for controlling a fluid pressure within the crankcase is disposed in the compressor housing. The control valve includes a valve casing defining a chamber therein. The valve casing includes a suction port in fluid communication with the suction cavity for providing the fluid at the suction pressure from the suction cavity to the chamber. A bellows is moveable in the chamber between an activated position and a neutral position. The member is responsive to the fluid at the suction pressure and is urged into the activated position when the suction pressure is below a pre-determined set-point. The activated position opens fluid communication between the discharge cavity and the crankcase while closing fluid communication between the suction cavity and the crankcase. The activated position is for pressurizing the crankcase with the fluid at the discharge pressure to decrease the angle of the wobble plate and thereby the piston stroke. The neutral position closes fluid communication between the discharge cavity and the crankcase while opening fluid communication between the suction cavity and the crankcase. The neutral position is for pressurizing the crankcase with the fluid at the suction pressure to increase the angle of the wobble plate, and thereby the piston stroke, so that the compressor assembly operates at maximum capacity. A solenoid is connected to the member and responsive to an electric signal for actuating the member into the activated position when the suction pressure is above the pre-determined set-point.

Accordingly, the solenoid must be capable of providing a sufficient force to mechanically move the member into the activated position to allow the fluid at the discharge pressure to flow into the crankcase to de-stroke the compressor.

SUMMARY OF THE INVENTION AND ADVANTAGES

The subject invention provides a compressor assembly for a climate control system of a vehicle. The assembly includes a compressor housing defining a suction cavity for receiving a fluid at a suction pressure, a discharge cavity for receiving the fluid from the suction cavity at a discharge pressure higher than the suction pressure, and a crankcase in fluid communication with the discharge cavity. The crankcase encloses a variable angle wobble plate and at least one piston having a variable piston stroke. A valve casing is disposed in the compressor housing and defines a chamber therein. A member is moveable in the chamber between an activated position and a neutral position. The activated position opens fluid communication between the discharge cavity and the crankcase while closing fluid communication between the suction cavity and the crankcase for pressurizing the crankcase with the fluid at the discharge pressure to decrease the piston stroke. The neutral position closes fluid communication between the discharge cavity and the crankcase while opening fluid communication between the suction cavity and the crankcase for pressurizing the crankcase with the fluid at the suction pressure to increase the piston stroke. The valve casing includes an actuator port in fluid communication with the discharge cavity for providing the fluid flow at the discharge pressure to the chamber for urging the member into the activated position in response to the fluid flow at the discharge pressure.

Accordingly, the subject invention provides a variable displacement compressor assembly, which uses the fluid flow at the discharge pressure from the discharge cavity, in lieu of a solenoid, to urge the member into the activated position for opening fluid communication between the discharge cavity and the crankcase to de-stroke the compressor assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
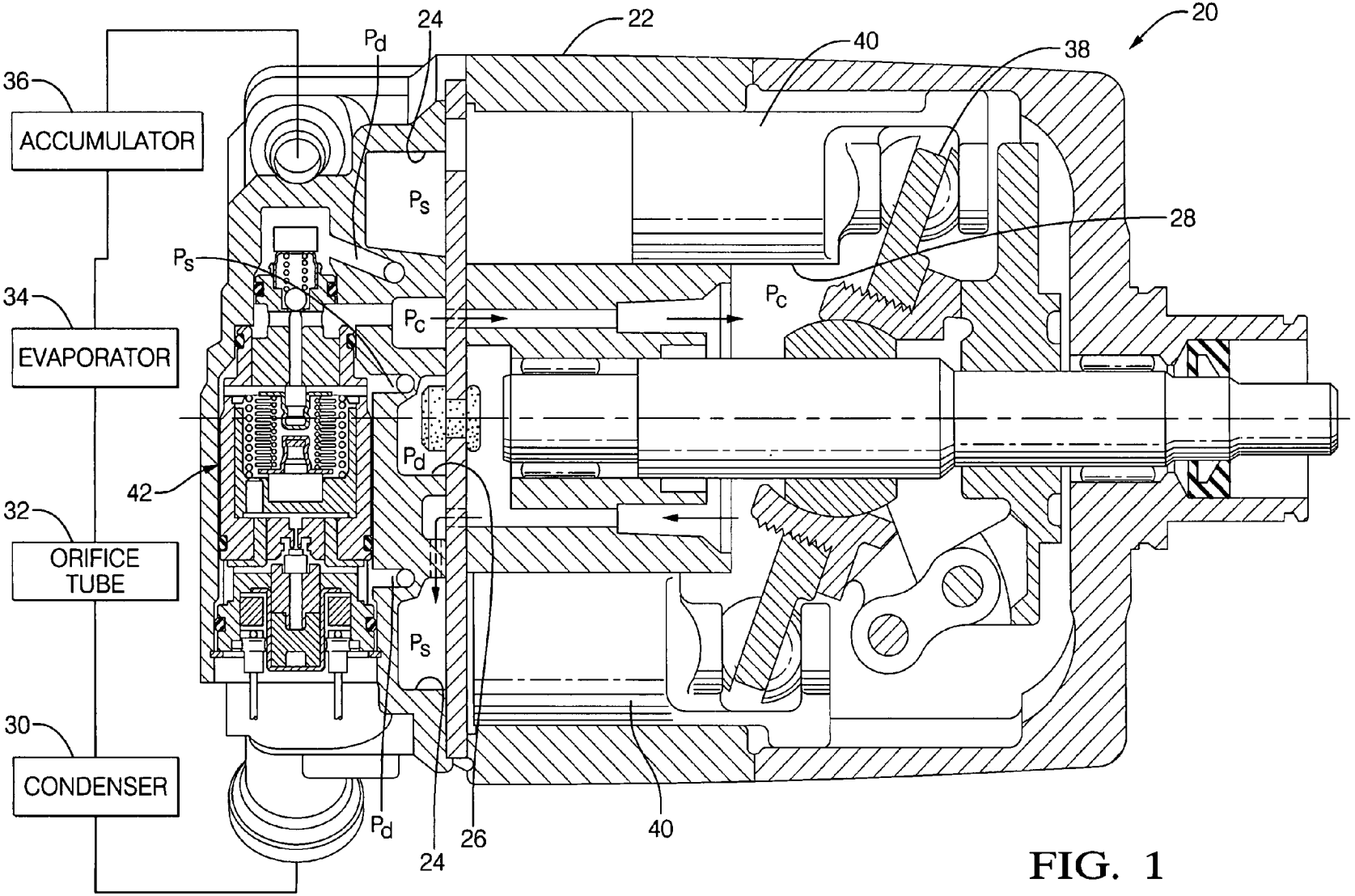
FIG. 1 is a cross sectional view of a compressor assembly.

Referring to the Figures, wherein like numerals indicate corresponding parts throughout the several views, a compressor assembly is shown in FIG. 1 generally at 20.

The compressor assembly 20 is of the variable angle wobble plate type for use in an air conditioning system of a motor vehicle. The compressor assembly 20 includes a compressor housing 22 defining a suction cavity 24 for receiving a fluid (refrigerant) at a suction pressure, a discharge cavity 26 for receiving the fluid from the suction cavity 24 at a discharge pressure higher than the suction pressure, and a crankcase 28 in fluid communication with the discharge cavity 26. The air conditioning system includes a normal condenser 30, an orifice tube 32, an evaporator 34, and an accumulator 36, arranged in that order between the discharge cavity 26 and the suction cavity 24 respectively. The crankcase 28 encloses a variable angle wobble plate 38 and at least one compressor piston 40 having a variable piston stroke.

The variable stroke of the compressor pistons 40 (only two being shown), and thereby the displacement of the compressor assembly 20, is determined by the operating angle of the compressor's variable angle wobble plate 38. The wobble plate 38 is made to angulate by pressurizing the sealed crankcase 28 with the fluid from the discharge cavity 26 at the discharge pressure, and controlling the fluid pressure in the crankcase 28 relative to the suction pressure. A control valve 42 is disposed in the compressor housing 22 and is responsive to the suction pressure to increase the variable piston stroke, and thereby the displacement of the compressor assembly 20 with an increase in the suction pressure of the fluid from the suction cavity 24.

Figure 2:
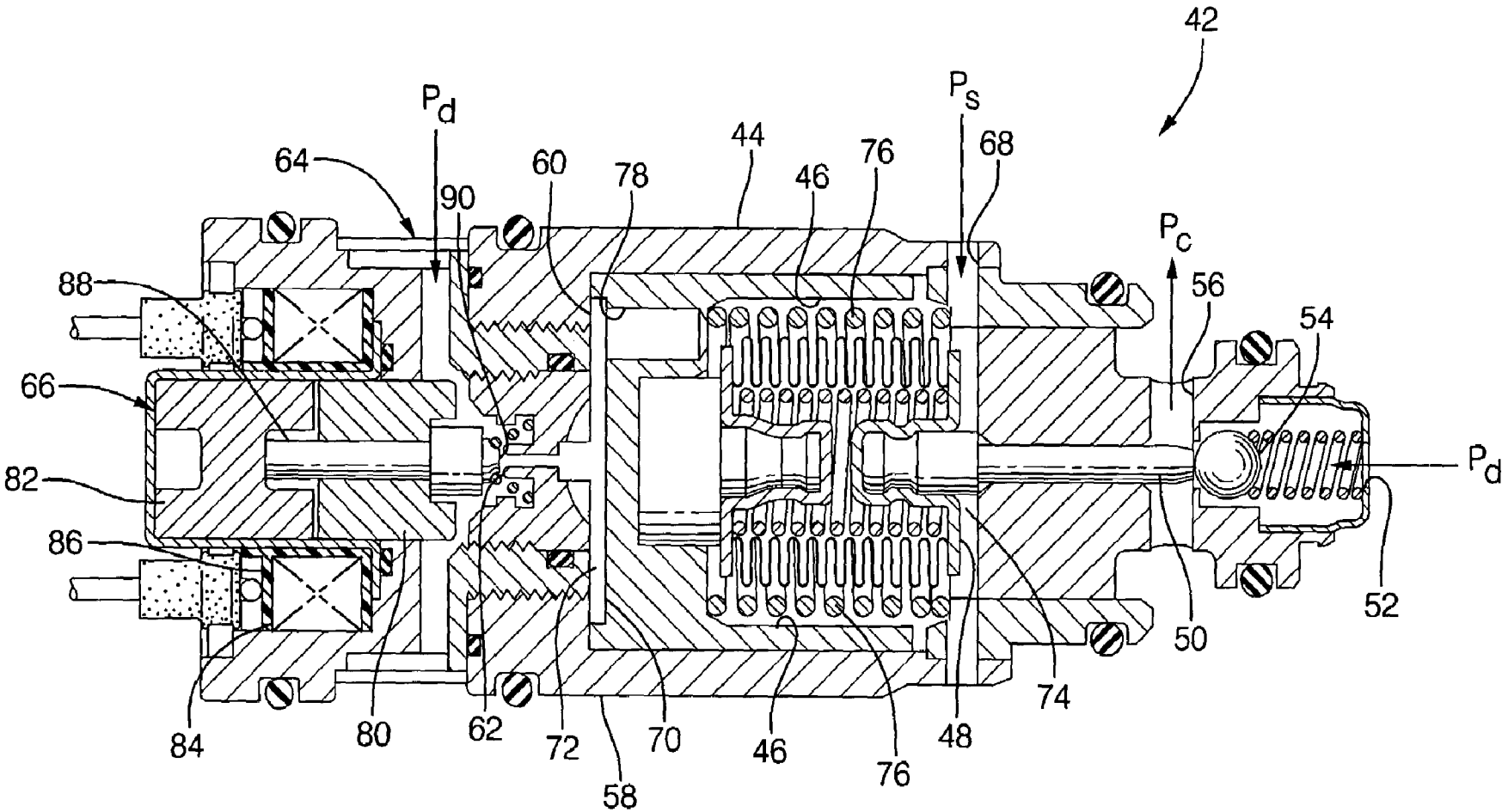
FIG. 2 is a cross sectional view of a first embodiment of the electronic control valve of the compressor assembly.
Figure 3:
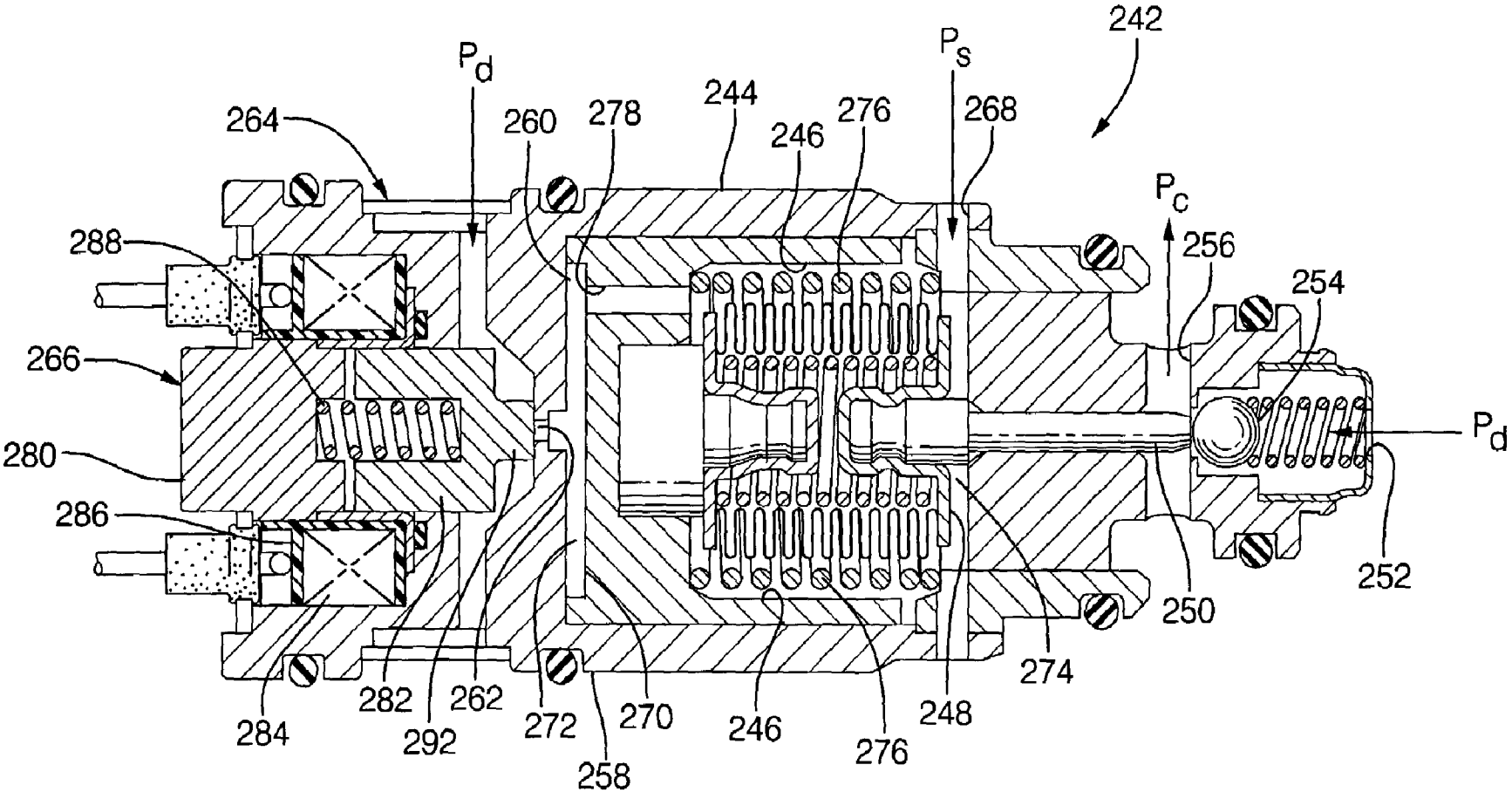
FIG. 3 is a cross sectional view of a second embodiment of the electronic control valve.

Referring to FIGS. 2 and 3, the control valve is generally shown at 42, and includes a valve casing 44, which defines a chamber 46 therein. A member 48 is moveable in the chamber 46 between an activated position and a neutral position. The member 48 may be a bellows, a diaphragm aneroid, or any other internal suction pressure sensing element known to those skilled in the art. The activated position opens fluid communication between the discharge cavity 26 and the crankcase 28, while closing fluid communication between the suction cavity 24 and the crankcase 28. The activated position is for pressurizing the crankcase 28 with the fluid at the discharge pressure to decrease the piston stroke. The neutral position closes fluid communication between the discharge cavity 26 and the crankcase 28, while opening fluid communication between the suction cavity 24 and the crankcase 28 for pressurizing the crankcase 28 with the fluid at the suction pressure to increase the piston stroke.

During normal operation, the fluid leaving the accumulator 36 at the suction pressure enters the suction cavity 24 of the compressor assembly 20 and is discharged to the discharge cavity 26 of the compressor assembly 20 at the discharge pressure, and thence to the condenser at a certain rate, which is dependent upon the angle of the wobble plate 38. At the same time, the fluid from the suction cavity 24 at the suction pressure is transmitted to the control valve 42 to act on the member 48, which tends to expand in response to a decrease in the suction pressure once the suction pressure falls below a pre-determined set-point. The member 48 provides a force to an output rod 50, which opens a crankcase charge port 52 by lifting a ball valve 54. The crankcase charge port 52, when open, communicates the fluid at the discharge pressure in the discharge cavity 26 with the crankcase 28 via a crankcase port 56.

The fluid from the discharge cavity 26 at the discharge pressure acts on the ball valve 54 in opposition to the member 48 to urge the ball valve 54 and the member 48 into the neutral position when the suction pressure of the fluid from the suction cavity 24 is above the pre-determined set-point. The pressure biases between the suction pressure and the discharge pressure are in addition to a spring bias from the member 48, which act to normally condition the member 48 in the neutral position to thereby normally effect maximum compressor displacement by establishing a zero crankcase 28 suction pressure differential.

The valve casing 44 includes a cylindrical central portion 58 having a closed end 60. The central portion 58 of the valve casing 44 defines the chamber 46 therein. The member 48 is disposed within the chamber 46 defined by the central portion 58 of the valve casing 44. The closed end 60 of the central portion 58 of the valve casing 44 defines an actuator port 62 in fluid communication with the discharge cavity 26. The actuator port 62 includes a diameter ($d_{ap}$) sufficient in size to provide the fluid flow at the discharge pressure to the chamber 46. The fluid flow at the discharge pressure urges the member 48 into the activated position.

The control valve 42 includes a control mechanism generally indicated at 64, for opening the actuator port 62 to allow fluid communication between the discharge cavity 26 and the chamber 46 and closing the actuator port 62 to prevent fluid communication between the discharge cavity 26 and the chamber 46. The valve casing 44 includes a suction port 68 in fluid communication with the suction cavity 24 for providing the fluid flow at the suction pressure form the suction cavity 24 to the chamber 46. As described in each of the embodiments, the control mechanism 64 includes a solenoid generally indicated at 66, for opening and closing the actuator port 62 to controll the fluid flow into the chamber 46.

In a first and a second embodiment of the subject invention as shown in FIGS. 2 and 3 respectively, a piston 70 is disposed in the chamber 46 between the actuator port 62 and the suction port 68, bisecting the chamber 46 into a discharge pressure side 72 and a suction pressure side 74. The discharge pressure side 72 of the chamber 46 receives the fluid flow from the discharge cavity 26 at the discharge pressure through the actuator port 62. The suction pressure side 74 of the chamber 46 receives the fluid flow from the suction cavity 24 at the suction pressure through the suction port 68. The control valve 42 includes a spring 76 for biasing the piston 70 into the neutral position within the chamber 46 when the control mechanism 64 closes the actuator port 62. The spring 76 is disposed within the suction pressure side 74 of the chamber 46, biasing the piston 70 towards the closed end 60 of the central portion 58 of the valve casing 44. The member 48 is disposed in the suction pressure side 74 of the chamber 46 and is responsive to the fluid flow at the suction pressure from the suction cavity 24 for moving the member 48 into the activated position when the suction pressure is below the pre-determined set-point.

The piston 70 includes a bleeder port 78 interconnecting the discharge pressure side 72 of the chamber 46 and the suction pressure side 74 of the chamber 46. The bleeder port 78 equalizes the pressure differential between the fluid at the discharge pressure in the discharge pressure side 72 of the chamber 46 and the fluid at the suction pressure in the suction pressure side 74 of the chamber 46. The bleeder port 78 includes a diameter ($d_{bp}$) less then the diameter of the actuator port 62, so that when the control mechanism 64 opens fluid communication between the discharge cavity 26 and the chamber 46, fluid will flow through the actuator port 62 faster than the fluid will flow through the bleeder port 78.

In the First embodiment of the control valve 42, as shown in FIG. 2, the solenoid 66 is activated by an electrical current to close the actuator port 62. In the absence of an electrical current, the actuator port 62 is open, and the fluid from the discharge cavity 26 at the discharge pressure flows into the chamber 46 to de-stroke the compressor assembly 20. The solenoid 66 includes a pole piece 80 adjacent the closed end 60 of the central portion 58 of the valve casing 44. An armature 82 is disposed next to the pole piece 80 and moveable toward the pole piece 80 in the presence of the electric current. A coil 84 is wrapped around a bobbin 86, which surrounds the armature 82 and pole piece 80. A shaft 88 extends from the armature 82, though the pole piece 80 and includes a sealing end 90 for abutting against the actuator port 62. The electric current passes through the coil 84 and produces a magnetic field, which draws the armature 82 and the shaft 88 toward the pole piece 80, thereby bringing the sealing end 90 of the shaft 88 into sealing engagement with the actuator port 62 to close fluid communication between the discharge cavity 26 and the chamber 46.

Accordingly, when the solenoid 66 is configured as described in the First embodiment, the compressor assembly 20 does not require the use of a drive clutch (not shown) to disengage the compressor assembly 20 during certain operating conditions. When an occupant of the vehicle signals to activate the air conditioning system, the electric current flows to the solenoid 66, which closes the actuator port 62 so that the compressor assembly 20 operates at capacity. When the air conditioning system is disengaged, the electric current to the solenoid 66 is disrupted, and the actuator port 62 is opened to allow fluid communication between the discharge cavity 26 at the discharge pressure into the chamber 46 to urge the member 48 into the activated position to de-stroke the compressor assembly 20. Therefore, no clutch is necessary, which reduces the weight and cost of the compressor assembly 20.

Elements of a second embodiment, which are similar to the elements of the first embodiment, are indicated by the same numeral used in the first embodiment preceded by the number two. As shown in FIG. 3, the solenoid 266 is activated by an electrical current to open the actuator port 262. In the absence of the electrical current, the actuator port 262 is closed, preventing the fluid from the discharge cavity 26 from entering the chamber 246. The solenoid 266 includes an armature 282 adjacent the closed end 260 of the central portion 258 of the valve casing 244. A pole piece 280 is disposed next to the armature 282. A coil 284 is wrapped around a bobbin 286, which surrounds the armature 282 and the pole piece 280. The armature 282 includes a sealing portion 292 for abutting the actuator port 262, and is moveable away from the actuator port 262 in the presence of the electrical current. The electric current passes through the coil 284, producing a magnetic field, which draws the armature 282 toward the pole piece 280 and away from the actuator port 262 so that the sealing portion 292 of the armature 282 is not in sealing engagement with the actuator port 262. Thus, fluid communication is opened between the discharge cavity 26 and the chamber 246.

Accordingly, the control valve 242 described in the second embodiment includes a second set-point that de-strokes the compressor assembly 20, instead of disengaging a drive clutch (not shown). The first and second set-points can be any two modes chosen from a group including: a rapid cool down mode, which permits intermittent operation below an evaporator temperature of 0° C.; a normal pneumatic mode, which permits operation at an evaporator temperature just above 0° C.; a fuel economy mode, which permits operation at an evaporator temperature of approximately 10° C.; and a full de-stroke mode.

Figure 4:
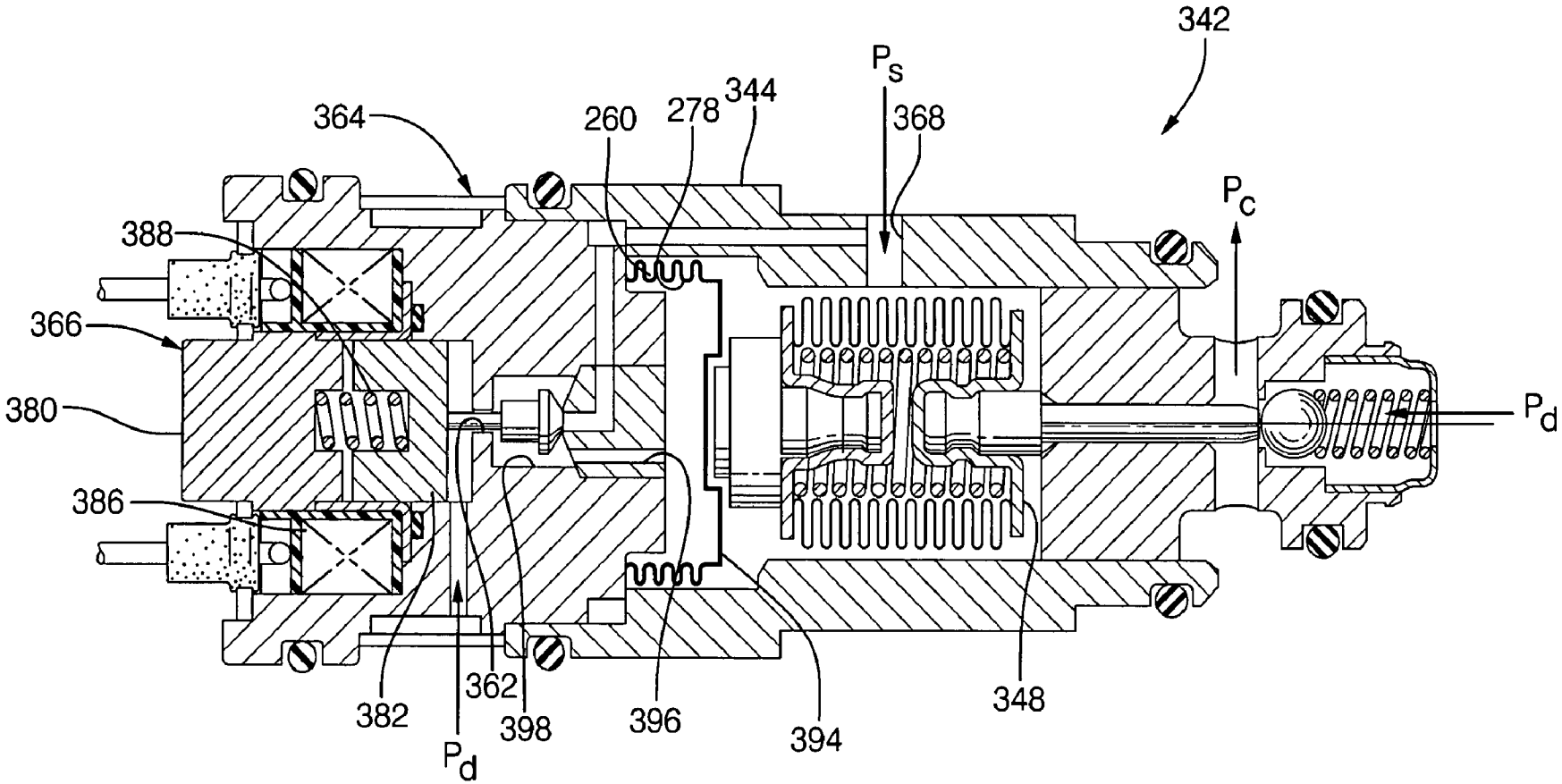
FIG. 4 is a cross sectional view of a third embodiment of the electronic control valve.

Elements of a third embodiment, which are similar to the elements of the first embodiment, are indicated by the same numeral used in the first embodiment preceded by the number three. As shown in FIG. 4, the control valve 342 includes an expandable device 394 in fluid communication with the actuator port 362. The valve casing 344 includes a control chamber 398 in fluid communication with the actuator port 362 and the suction port 368. A bleeder port 378 interconnects the control chamber 398 to the expandable device 394. The expandable device 394 is disposed between the control chamber 398 and the member 348 for expanding in response to the fluid flow at the discharge pressure from the discharge cavity 26 and urging the expandable device 394 and the member 348 into the activated position.

The solenoid 366 of the third embodiment of the control valve 342 is activated by an electrical current to close the actuator port. In the absence of an electrical current, the actuator port 362 is open, and the fluid from the discharge cavity 26 at the discharge pressure flows into the control chamber 398. Simultaneously, in the absence of an electrical current, the solenoid 366 closes fluid communication between the control chamber 398 and the suction pressure port 368. Accordingly, in the absence of an electrical current, the fluid flow from the discharge cavity 26 at the discharge pressure flows into the expandable device through a deactivation port 396 to expand the expandable device and urge the member 348 into the activated position. When an electrical current is present, the solenoid 366 closes the actuator port and opens fluid communication between the control chamber 398 and the suction pressure port 368. Accordingly, when an electrical current is present, the fluid flow from the suction cavity 24 at the suction pressure draws the expandable device 394 back to the neutral position. While the control valve 342 of the third embodiment is not shown with a piston, it is contemplated that a piston could be disposed between the expandable device 394 and the member 348. Accordingly, the scope of the third embodiment of the control valve 342 should not be so limited.

The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A compressor assembly for a climate control system of a vehicle, said assembly comprising:

a compressor housing defining a suction cavity for receiving a fluid at a suction pressure and a discharge cavity for receiving the fluid from said suction cavity at a discharge pressure higher than the suction pressure and a crankcase in fluid communication with said discharge cavity and enclosing a variable angle wobble plate and at least one compressor piston having a variable piston stroke;

a control valve disposed in said compressor housing and defining a chamber therein;

a member moveable in said chamber between an activated position opening fluid communication between said discharge cavity and said crankcase when the suction pressure is lower than a predetermined set-point, while closing fluid communication between said suction cavity and said crankcase for pressurizing said crankcase with the fluid at the discharge pressure to decrease said piston stroke and a neutral position closing fluid communication between said discharge cavity and said crankcase when the suction pressure is higher than a predetermined set-point, while opening fluid communication between said suction cavity and said crankcase for pressurizing said crankcase with the fluid at the suction pressure to increase said piston stroke; and said control valve including an actuator port having a closed position and an open position, and in fluid communication with said discharge cavity for providing the fluid at the discharge pressure to said member for biasing said member to have the predetermined set-point correspond to a first set-point when the actuator port is closed, and biasing said member to have the predetermined set-point correspond to a second set-point, different from the first set-point, when the actuator is open.

2. An assembly as set forth in claim 1 including a control mechanism for opening said actuator port to allow fluid communication between said discharge cavity and said chamber and closing said actuator port to prevent fluid communication between said discharge cavity and said chamber.

3. An assembly as set forth in claim 2 including a suction port in fluid communication with said suction cavity for providing the fluid flow at the suction pressure from said suction cavity to said chamber, and a piston disposed in said chamber between said actuator port and said suction port for bisecting said chamber into a discharge pressure side and a suction pressure side with said discharge pressure side of said chamber receiving the fluid flow from said discharge cavity at the discharge pressure through said actuator port and said suction pressure side of said chamber receiving the fluid flow from said suction cavity at the suction pressure through said suction port.

4. An assembly as set forth in claim 3 including a spring for biasing said piston into said neutral position within said chamber in response to said control mechanism closing said actuator port.

5. An assembly as set forth in claim 4 wherein said member is disposed in said suction pressure side of said chamber and is responsive to the fluid flow at the suction pressure from said suction cavity for moving said member into said activated position when the suction pressure is below the pre-determined set-point.

6. An assembly as set forth in claim 5 wherein said piston includes a bleeder port interconnecting said discharge pressure side of said chamber and said suction pressure side of said chamber for equalizing the pressure differential between the fluid at the discharge pressure in the discharge pressure side and the fluid at the suction pressure in the suction pressure side of said chamber.

7. An assembly as set forth in claim 6 wherein said actuator port includes a diameter (dap) and said bleeder port includes a diameter (dbp) less then said diameter of said actuator port.

8. An assembly as set forth in claim 7 wherein said control mechanism includes a solenoid for opening and closing said actuator port for controlling the fluid flow into said discharge chamber.

9. An assembly as set forth in claim 8 wherein said solenoid is activated by an electrical current to open said actuator port.

10. An assembly as set forth in claim 8 wherein said solenoid is activated by an electrical current to close said actuator port.

11. An assembly as set forth in claim 2 including an expandable device in fluid communication with said actuator port and disposed between said actuator port and said piston within said discharge pressure side of said chamber for expanding in response to the fluid flow at the discharge pressure from said discharge cavity and urging said piston and said member into said activated position.

12. An assembly as set forth in claim 11 wherein said expandable device includes a deactivation port in fluid communication with said suction cavity and controlled by said control mechanism and said activated position includes opening said actuator port and closing said deactivation port for allowing fluid communication between said discharge cavity and said expandable device and said neutral position includes closing said actuator port and opening said deactivation port for allowing fluid communication between said suction cavity and said expandable device.

* * * * *